US005508684A

United States Patent [19]

Becker

[11] Patent Number: 5,508,684

[45] Date of Patent: Apr. 16, 1996

[54] ARTICLE TAG

[76] Inventor: Richard S. Becker, 784 Circulo Miro, Anaheim, Calif. 92807

[21] Appl. No.: 397,744

[22] Filed: Mar. 2, 1995

[51] Int. Cl.[6] ..... G08B 13/14

[52] U.S. Cl. ..... 340/572; 340/573; 342/44; 361/765; 29/592.1

[58] Field of Search ..... 340/572, 573; 342/44; 361/765; 29/592.1

[56] References Cited

U.S. PATENT DOCUMENTS

| | | | |
|---|---|---|---|
| 3,292,080 | 12/1966 | Trikilis | 340/572 |
| 3,711,848 | 1/1973 | Martens | 340/572 |
| 3,810,147 | 5/1974 | Lichtblau | 340/572 |
| 3,823,244 | 1/1975 | Lichtblau | 340/572 |
| 3,828,337 | 8/1975 | Lichtblau | 340/572 |
| 3,913,219 | 10/1975 | Lichtblau | 29/592.1 |
| 3,967,161 | 6/1976 | Lichtblau | 340/572 |
| 4,021,705 | 5/1977 | Lichtblau | 340/572 |
| 4,117,466 | 9/1978 | Lichtblau | 340/572 |
| 4,168,496 | 9/1979 | Lichtblau | 340/572 |
| 4,369,557 | 1/1983 | Vandebult | 340/572 |
| 4,567,473 | 1/1986 | Lichtblau | 340/572 |
| 4,598,276 | 7/1986 | Tait | 340/572 |
| 4,626,311 | 12/1986 | Taylor | 340/572 |
| 4,783,646 | 11/1988 | Matsuzaki | 340/572 |
| 4,992,776 | 2/1991 | Crossfield | 340/572 |
| 4,999,609 | 3/1991 | Crossfield | 340/572 |
| 5,049,856 | 9/1991 | Crossfield | 340/572 |
| 5,081,446 | 1/1992 | Gill et al. | 340/572 |
| 5,103,210 | 4/1992 | Rode et al. | 340/572 |
| 5,170,045 | 12/1992 | Bengtsson | 340/572 |
| 5,182,544 | 1/1993 | Aquilera et al. | 340/572 |
| 5,241,163 | 8/1993 | Vachtsevanos et al. | 235/449 |
| 5,280,159 | 1/1994 | Schultz et al. | 235/382 |

*Primary Examiner*—Brent A. Swarthout
*Assistant Examiner*—Benjamin C. Lee
*Attorney, Agent, or Firm*—Curtis L. Harrington

[57] ABSTRACT

The tag circuit system uses resonant circuit technology in conjunction with an insulative substrate and conductive ink or metal conductor to permit the tag to be sewn into the clothing, protecting the circuit elements, yet providing a trace on a portion of the tag which can be clipped from the main portion of the tag to change the operation of the tag. The tag can be configured to resonate at a first frequency outside the frequency of detection, be clipped to resonate at the frequency of detection, and there after subjected to an over current condition to cause the circuit to fail to an open circuit condition to thence be disabled; or it may initially resonate at the detection frequency and then be clipped to an open circuit condition to thence be disabled. The circuit components may be formed of conductive ink or stamped from metal sheet enabling the tag to be inexpensive and to make the circuit components less prominent, particularly where the color of ink used matches the color of the dielectric substrate. These tags are inexpensive and tamper proof and may be incorporated into the body of an article to be protected. The tags do not need to be purchased, attached, inventoried, controlled or handled by the retailer and thus reduce selling expense.

20 Claims, 4 Drawing Sheets

ARTICLE TAG

FIELD OF THE INVENTION

The present invention relates to the field of electronic tag devices, such as those used to indicate presence or passage as used in conjunction with a security system. More specifically, the present invention relates to an integrated system for efficient and highly controllable use of an inexpensive tag which reacts to electromagnetic energy and which is highly integrated into articles, especially clothing and cloth articles and will provide a higher degree of security and lessen the incidence of circumvention of the security intended to be provided.

BACKGROUND OF THE INVENTION

One of the breakthroughs in security associated with retail merchandizing has been the advent of electromagnetically responsive tag systems. Today, these are used in clothing stores, libraries, and book stores. The overall topology involves a tag which is responsive to electromagnetic energy and which will trigger an alarm system if a patron attempts to leave with the item without having the item tag disabled from tripping the alarm. For books and other devices presenting the opportunity to have the device hidden, thefts have been deterred significantly. The dishonest patron has only a small chance of finding the device, and still cannot be certain if there might be another located on the book. Therefore as to books and the like, the currently used systems have proven effective.

With clothing, there are still practical problems involved. It is difficult to effectively hide the electromagnetically activated tags commonly available on clothing. If sewn into the clothing, such tags would be difficult to physically remove without having to rip clothing seams. When attached to the outside of clothing, they may be found and easily removed by thieves.

As a result, the technology of the past few years has emphasized the mechanical nature of these tags. Elaborate tags have been designed which cause a small nail sized pin to pierce the clothing from one side and be secured on the other side to a pivotal piece of the tag. The locking mechanism is a mechanical lock on the pin, either through friction, or into a groove cut in the pin or nail. The problems with this arrangement is that the pin or nail can significantly destructively effect the clothing upon which it is mounted. Where the pin or nail is made of a rustable metal, moisture can cause rust to be formed along the shaft, which may wick into the clothing material. Not only can discoloration occur, but the rust can chemically destroy the clothing.

It was discovered that by placing pressure on the unlock mechanism, a thief can open these devices. Since the thief's unlocking pressure tended to be less evenly distributed than the tool intended to unlock the tag, the inventors went a step farther and placed vials of dye in the clothing tag to further stain and ruin the clothing on the theory that having the clothing ruined is better than having it stolen.

The engineering techniques employed in tagging systems are known, and the following examples are incorporated by reference herein. U.S. Pat. No. 5,280,159 issued to Schultz et al. on Jan. 18, 1994 and entitled *MAGNETIC RADIO FREQUENCY TAG READER FOR USE WITH A HAND-HELD TERMINAL* discloses a gun-style reader which reads information from a tag when the tag is exposed to a low frequency magnetic field. U.S. Pat. No. 5,241,163 issued to Vachtsevanos et al. on Aug. 31, 1993 and entitled *ARTICLE IDENTIFICATION APPARATUS AND METHOD USING A FERROMAGNETIC TAG* discloses the use of magnetic bars and non-magnetic strips which can be read as a bar code.

U.S. Pat. No. 5,182,544 issued to Aquilera et al. on Jan. 26, 1993 and entitled *SECURITY TAG WITH ELECTROSTATIC PROTECTION* discloses the use of flat formed capacitors and inductors on a tag, and emphasizes the use of a static dissipation member. The scheme discloses a frangible connection between the plates of capacitors C2 and C4. Where the preferred frequency is 8.2 MHz for the tag security system, the frangible connection is set to cause the tag frequency to be 16 MHz. When the tag is exposed to sufficiently high levels of 16 MHz energy, the frangible connection burns out, leaving a circuit intact which now operates at 8.2 MHz. The problem here is not knowing whether you have actually altered the resonant frequency of each tag except by testing it, and especially where the application of the burnout energy may be dependent upon the orientation and momentary field strength of the applied field. Where the burnout fails, the tag will fail to trigger in the alarm system, and goods bearing the tags may be easily stolen. Further, there is no affirmative way of knowing whether the tags are in a triggering or non-triggering condition based upon inspection.

U.S. Pat. No. 5,170,045 issued to Bengtsson on Dec. 8, 1992 and was entitled *PRICE TAG DEACTIVATOR*, discloses rows of alternately polarized magnets, used with magnetic strips on bar code price tags to alarm when the price is not scanned, and includes the banks of magnets incorporated with the scanning system to automatically demagnetize during scanning.

U.S. Pat. No. 5,103,210 issued to Rode et al. issued on Apr. 7, 1992 and entitle *ACTIVATABLE/DEACTIVATABLE SECURITY TAG FOR USE WITH AN ELECTRONIC SECURITY SYSTEM* discloses a tag activate by changing the resonating frequency to a second resonating frequency by again exposing the tag to electromagnetic frequency to burn out or alter the circuit. This scheme also suffers from the limitations outlined above for the U.S. Pat. No. 5,182,544.

U.S. Pat. No. 5,081,446 issued to Gill et al. on Jan. 14, 1992 and entitled *SECURITY TAG FOR COMPACT DISC STORAGE CONTAINER* discloses the formation of a circuit whose frequency is formed by interaction between a compact disc and the casing. U.S. Pat. No. 5,049,856 issued to Crossfield on Sep. 17, 1991 and entitled *ANTIPILFERAGE SYSTEMS*, discloses spiral wound emitter and detector coils for use with tags to make a tag less orientationally dependent in detection of the tag's signal.

U.S. Pat. No. 4,999,609 issued to Crossfield on Mar. 12, 1991 and entitled *ANTIPILFERAGE TAGS HAVING AN ACOUSTIC RESONATOR CHAMBER* discloses a three dimensional structure having a magnetorestrictive material where the alarm tone comes directly from the tag's acoustic resonator chamber. U.S. Pat. No. 4,992,776 issued to Crossfield on Feb. 12, 1991 and entitled *ANTIPILFERAGE TAGS AND THEIR USE* discloses a system to work with the magnetorestrictive material in a tag.

U.S. Pat. No. 4,567,473 issued to Lichtblau on Jan. 28, 1986 and entitled *RESONANT TAG AND DEACTIVATOR FOR USE IN AN ELECTRONIC SECURITY SYSTEM* which again discloses the use of resonance to cause conductive failure, in this case by vaporization, to destroy the resonant nature of the circuit. Again and depending upon the user's ability to see the circuitry, the tag's disablement may not be immediately discernible. This is a disadvantage, since the purpose of the tag is that it be non-detectable by users as having a circuit or security function.

U.S. Pat. No. 4,168,496 issued to Lichtblau Sep. 18, 1979 and entitled *QUASI-STATIONARY NOISE CANCELLATION SYSTEM*, illustrates a circuit for cancelling spurious resonance in a detection system. U.S. Pat. No. 4,117,466 issued to Lichtblau Sep. 26, 1978 and *BEAT FREQUENCY INTERFERENCE REJECTION CIRCUIT*, illustrates a circuit for rejecting beat frequency in detection systems.

U.S. Pat. No. 84,021,705 issued to Lichtblau on May 3, 1977 and entitled *RESONANT TAG CIRCUITS HAVING ONE OR MORE FUSIBLE LINKS* discloses a circuit on a substrate which is fusible to destroy the link to open circuit by introduction of electromagnetic energy. U.S. Pat. No. 3,967,161 issued to Lichtblau on Jun. 29, 1976 and entitled *MULTI-FREQUENCY RESONANT TAG CIRCUIT FOR USE WITH AN ELECTRONIC SECURITY SYSTEM HAVING IMPROVED NOISE DISCRIMINATION* discloses the use of multiple frequencies as a spread spectrum method of improving noise rejection.

U.S. Pat. No. 3,913,219 issued to Lichtblau on Oct. 21, 1975 and entitled *PLANAR CIRCUIT FABRICATION PROCESS* discloses fabrication of planar electrical circuits having precision electrical characteristics, and includes materials such as polyethylene, polypropylene, Teflon based materials, and polyisobutylene, as well as the use of nitrocellulose inks. The method of interconnecting two sides of the circuit is not disclosed.

U.S. Pat. No. 3,863,244 issued to Jan. 28, 1975 and entitled *ELECTRONIC SECURITY SYSTEM HAVING IMPROVED NOISE DISCRIMINATION* discloses the use of a first circuit for detection and a second circuit to permit partial destruction of the first circuit to change it resonant frequency. U.S. Pat. No. 3,828,337 issued to Lichtblau on Aug. 6, 1974 and entitled *NOISE REJECTION CIRCUITRY* discloses circuitry for rejecting unintended pulses, by using a parallel noise inhibit function.

U.S. Pat. No. 3,810,147 issued to Lichtblau on May 7, 1974 and entitled *ELECTRONIC SECURITY SYSTEM* discloses the use of fusible ink in a tag in a system in which a continuous series of frequencies are swept, and which can be de-activated by a de-activation frequency. U.S. Pat. No. 3,292,080 issued to E. M. Trikilis on Dec. 13, 1966 and entitled *SYSTEM AND METHOD FOR PREVENTING PILFERAGE BY DETECTION OF MAGNETIC FIELDS* uses raw flux density as a qualifier to perform sensing.

SUMMARY OF THE INVENTION

The tag system of the present invention uses resonant circuit technology in conjunction with an insulative substrate and conductive ink or metal conductor to permit the tag to be sewn into the clothing. The insulative dielectric substrate can be printed with conductive inks which form conductive traces and plates or stamped to remove excess material which are configured as capacitors and inductors of the proper value to operate in conjunction with the particular frequency electromagnetic field available.

In a first embodiment, a leads exists which short circuits the inductive portion of the circuit such that the circuit, as it is printed or stamped on the material is initially disabled. The short circuiting lead extends along the bottom portion of the tag, where it may be cut off by a clothing store attendant to "arm" the tag. This is provided especially for smaller stores which may accept shipments through a guarded entrance or exit and do not wish to have the alarm triggered as packaged clothing arrives. Generally if a quantity of goods is sold by the manufacturer with armed tags installed, the goods could be sold legitimately via other channels, such as wholesale, etc., and if the consumer of such goods entered a store with an alarm system, he would set off the alarm. Therefore, it may be desirable to sew the tags into the garments in the disarmed state.

Once the attendant cuts the tag, the circuit components are no longer shorted, and assume the proper resonant relationship. The article of clothing then, if taken through the radio frequency absorption detector, would trigger the alarm. Once the clothing is purchased, a device having a set of conductors contacts the two severed leads and introduces direct current or alternating current flow into the circuit, causing the thinner leads in the circuit trace to fail open. Although this may be thought of as a "burn-out", the amounts of current are so small as to not create significant heat.

The tag of the present invention is printed or stamped on pliant dielectric material, and can be sewn into a seam, along with other regularly occurring clothing tags. In fact, the base material for the clothing tags which would be used in the clothing in any event can be used as a substrate upon which to support applicant's invention herein. In this case, a direct comparison between an earlier item of clothing having no tag and an item having a tag would yield a conclusion that there was no difference. Further, the conductive inks used can match the tag color, which would thus mask further the existence of a circuit.

Of course, the clothing may be shipped in a state in which triggering can occur, and then be "clipped" to a state where triggering is deactivated. If the tag could be "clipped" to de-activate, then anyone with a pair of scissors could de-activate the tag. These alternatives are present to provide a significant range of embodiments to maximize user options.

Regardless of the two circuitry options outlined above, the tag layout can further constitute a large number of layouts, of which three are specifically disclosed herein. In the first layout, the circuit elements may be added to a first side of a substrate material. The substrate may be then folded, welded or glued together (with appropriate accommodation given for the thickness of separation between the capacitive plates thus controlling the capacitance).

In a second physical configuration, and one in which the capacitance may be controlled by the thickness or area of the dielectric (substrate), a small area of expanded mesh through connect is made. When the conductive ink is printed on both sides, it is absorbed into the through mesh and will thus enable current to pass to one of the capacitor plates on the other side.

In a third physical configuration, one side of the tag has a coil and a pair of capacitive plates which are connected to the coil. The other side of the tag has a second pair of capacitive plates linked by a single conductor. In this configuration, a two-sided tag can be used, but there is no necessity for providing a through hole conductive connection.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
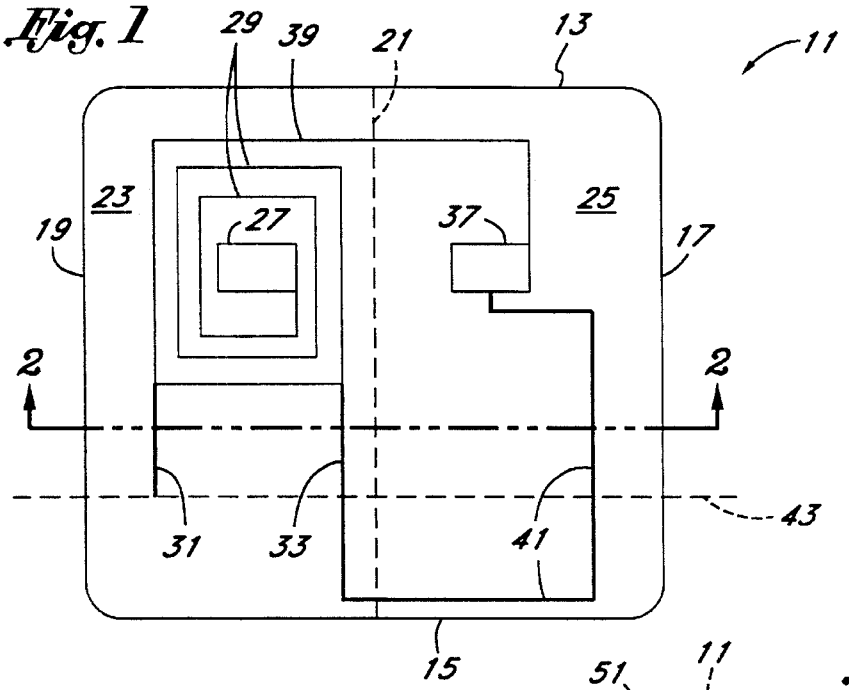
FIG. 1 is a front view of a foldable tag utilizable in the present invention and illustrating a portion of the circuit which may be clipped in order to activate the device's operation in an electromagnetic field.

The description and operation of the invention will be best described with reference to FIG. 1. FIG. 1 is a tag 11 shown in un-folded form. On the side facing the viewer can be seen the upper edge 13 and lower edge 15. A right edge 17 opposes a left edge 19. A center fold axis 21 shown in dashed line format extending from the upper edge 13 to the lower edge 15 illustrates the fold which may be applied to the tag 11 which would cause the halves of the circuitry on areas of tag 11 to face away from each other. In other words, the circuitry shown would not be folded into a facing opposing relationship, but in a relationship where they faced away from each other.

The fold axis separates the tag 11 into left half 23 and a right half 25. The circuitry shown on the left half 23 includes a capacitive area of conductor, or capacitive plate 27 surrounded by a coil of conductor 29 surrounding the plate 27. Extending away from the coil 29 on the left half of the tag 11 is a first thickened trace 31 and a second thickened trace 33. The width of the traces 31 and 33, assuming a constant depth, translates into an increased current flow area. The presence of two traces 31 and 33 will enable two types of tools to disable the tag 11, as will be shown.

The right half 25 off the tag 11 includes a capacitive plate 37, and a conductor 39 extending between the right half 25 and the left half 23 which connects the capacitive plate 37 to the coil 29. The right half 25 of the tag 11 also includes a conductor 41 extending away from the capacitive plate 37 and toward the lower edge 15 and onward to the left half 23, connecting up with trace 33.

Extending across both halves 23 and 25 of the tag 11, a cut line 43, also in dashed line format, is shown which would sever conductivity between the conductor 41 and the trace 33 if the tag 11 were cut along the cut line 43. Elimination of this line of current would change the resonant frequency of the circuit between the capacitor of plates 27 and 37, and the coil 29. This is because the elimination of conductor 41 would create another three-quarter winding about the plate 27. The extent to which conductor 41 can cause a change in the resonant frequency can be increased by having the trace 33 tap into the coil 29 at a point nearly halfway in to the plate 27. Other variations for having the severance of a conductor change the resonant frequency of a capacitor-inductor pair are fully contemplated to be used in the invention of the present application.

Figure 2:
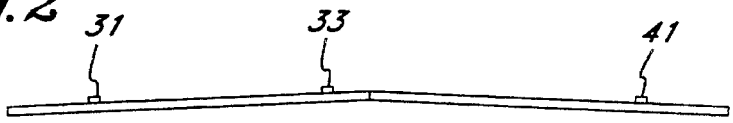
FIG. 2 is a view taken along line 2—2 of FIG. 1 and illustrating the conductors applied to the surface of the tag.

Referring to FIG. 2, a view of the tag 11 taken along line 2—2 of FIG. 1 illustrates a slight angle of fold, as well as the conductive traces 31, 33, and 37 extending from the tag 11. The tag 11 of FIG. 2 is shown bent at a slight angle to illustrate the direction in which the bend will occur.

In folding the back sides of the right and left halves 23 and 25 together, care must be taken to insure that the distances between the capacitive plates 27 and 37 is uniform and controlled. In forming the capacitor, the plates 27 and 37 will be separated by two thicknesses of material of the tag 11, as well as any glue or other bonding material. As is known, the capacitive value is determined by the composite characteristics of the dielectric separating the plates 27 and 37, as well as the distance of separation.

Figure 3:
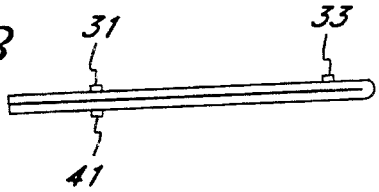
FIG. 3 is the view taken along line 2—2 of FIG. 1 after the tag of FIGS. 1 and 2 is folded.

Once the right half 25 and the left half 23 of the tag 11 are brought together along the fold line 21, the trace 31 will directly oppose the trace 41. This is shown in an end section view of FIG. 3. Once the tag 11 is cut along the bottom cut line 43, the trace 31 and trace 41 will extend near or at the bottom edge 15, but now on opposite sides of the folded tag 11. Because of the angle of the view of FIG. 3, the conductors 31, 33, and 41 at the bottom of the tag will have the same configuration as will be seen at the edge of the tag 11 after it is cut.

Figure 4:
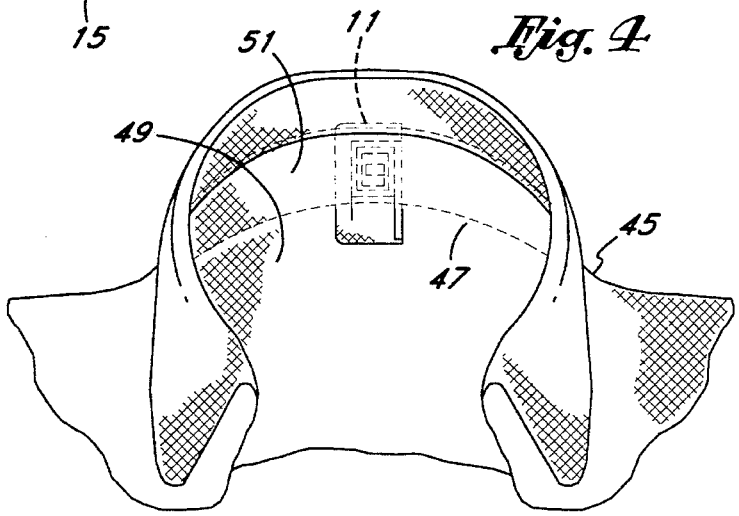
FIG. 4 illustrates the tag of FIGS. 1 and 2 after folding together and being sewn into the seam of a garment.

To illustrate the position of the tag 11 as it would appear protecting an object, it is shown in FIG. 4 being placed in a shirt 45. Here it is shown within a seam 47 formed by the back material 49 and the overlying material 51 of the shirt 45. Note that the electronic portions of the tag 11, namely the capacitive plate 27 (and the capacitive plate 37 behind and opposing it) and the coil 29 are within the seam and covered by the shirt. The conductors 31, 33, and 41 may be formed of multiple paths to prevent the sewing operation from damaging the conductivity through conductor 41, or inhibiting the availability to have access to the coil 29 through the first thickened trace 31.

When the tag 11 is covered and within the seam 47, the user will be unaware of the presence of the electronic components of the tag 11, or even the fact that tag 11 is an electronic component set. Further, the Ink used to form the conductors 31, 33, and 41 may match the tag 11 color, as well as the color of the shirt 45. This will further inhibit the detection of the tag 11.

To now disable the tag 11, a direct current is introduced into the trace 33 and into the trace 41. Since trace 33 and trace 41 is of a thicker dimension, and therefore greater cross sectional area than the conductor 39, once current begins to flow through the conductor 33, it must (now that conductor 41 is severed) flow through conductor 39 to reach conductor 41. Sufficient voltage and current is applied that the conductor 39 will "burn out" or fail open. Once conductor 39 fails open, the tag 11 circuitry will be disabled.

Figure 5:
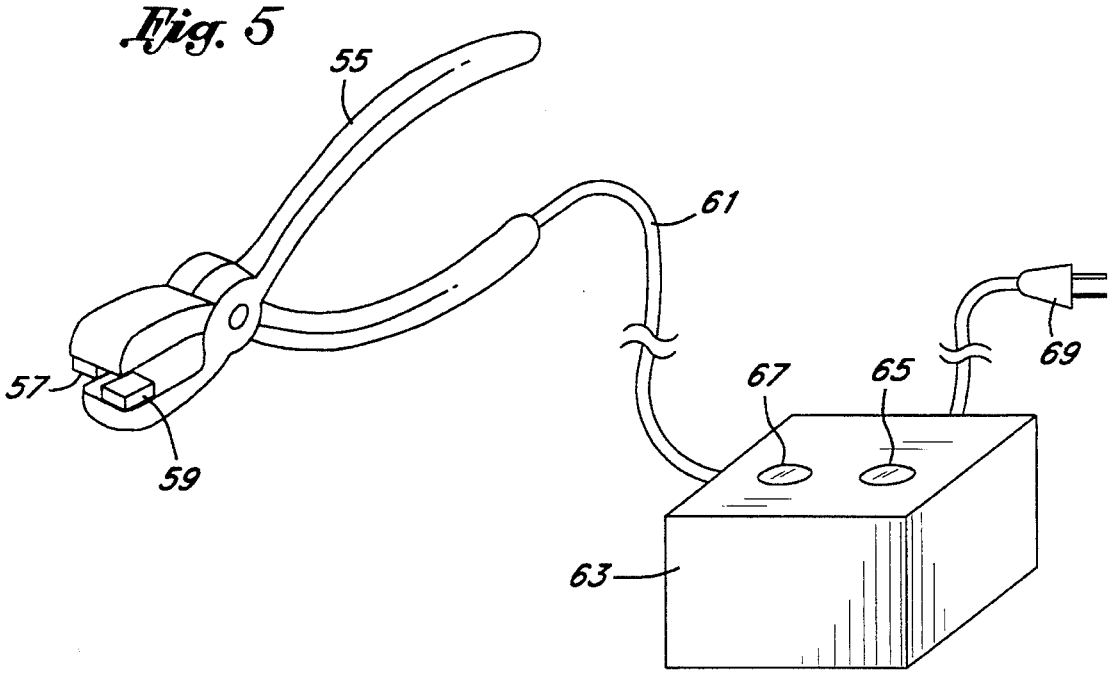
FIG. 5 illustrates the application of a pliers-like device which may be direct or alternating current powered and which engages the tags of the present invention to cause the conductors on the tag to fail from simple over current resistance heating, as well as an indicator box to facilitate the use by retail employees.

Referring to FIG. 5, a perspective view of a set of pliers 55 can be used to disable the circuitry of the tag 11. Rather than have the conductive elements of the pliers 55 oppose each other and create the risk of short circuiting, the conductive elements including upper element 57 and lower element 59 are offset. In this manner, the upper element will engage conductor 33, while the lower element 59 will engage conductor 41. This method also contemplates the use of other than pliers 55, including another type of conductive mechanical device which has a positive supply of current overlying a negative supply of current.

Also in FIG. 5, the pliers 55 are shown as having an electrical lead 61 extending to a housing 63 which would support a pair of light indicators 65 and 67. The light indicators 65 and 67 could be used to indicate a conducting and non conducting state of the pliers 55. Ideally, the circuitry (not shown) within the housing 63 could be powered from a standard alternating current cord set 69 which could plug into standard electrical outlets.

Of course, since the tag 11 is disabled on low voltage current, a self contained pliers 55 device, operable with batteries, could also be possible. This would especially facilitate the use of the tag system at remote locations, such as in a warehouse, or to avoid carrying clothing with activated tags to a location having an electrical outlet.

The light indicators 65 and 67 could conceivably be red and green indicators. Typically, when contact is first made, a red one of the indicators 65 and 67 would illuminate indicating that current was flowing and that the tag had not yet been disabled. Later, as the circuitry is overloaded to failure, a green one of the indicators 65 and 67 would illuminate indicating that current was not flowing and that the tag is now disabled. In this manner and with this solution, the retail employees have a positive verification that (1) the circuitry was positively engaged, and (2) changed to open circuit or disable the circuitry.

Another method of failure could involve the introduction of current into conductor 41 and conductor 31 simultaneously, to again short conductor 39 to the open condition. This would simply involve a pair of conductive pliers or other structures whose contact points are separated only above and below the tag 11, and not separated by some width as is shown in FIG. 5.

Figure 6:
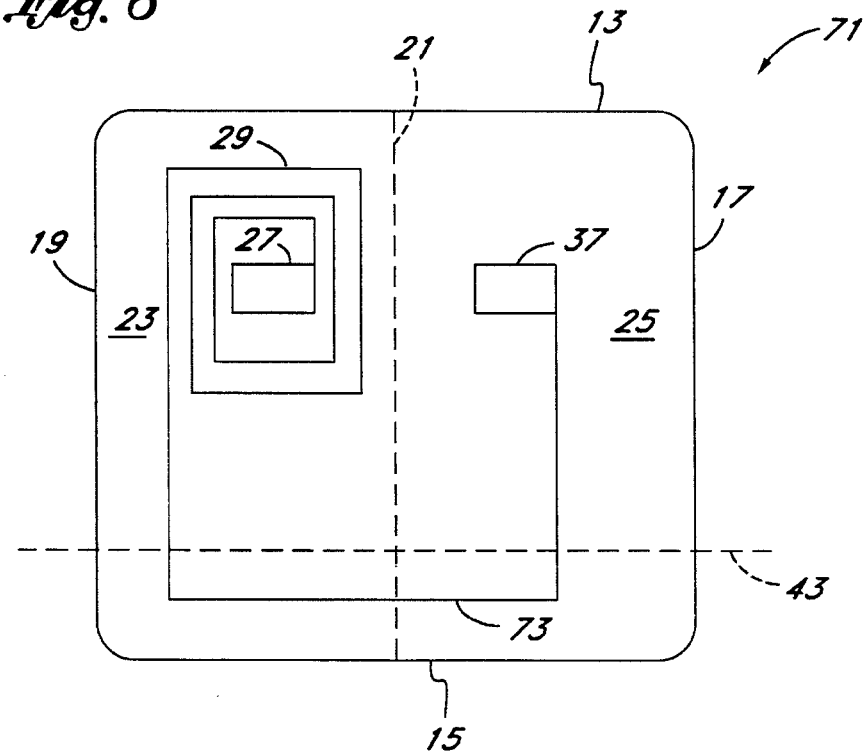
FIG. 6 is a plan view of a tag, similar in overall topology to that shown in FIG. 1, but which is initially in the armed state and which may be clipped to sever the circuit and assume an unarmed state.

Referring to FIG. 6, a tag 71 has a layout similar to that shown in FIG. 1, except that the portion of conductor, in this case conductor 73 which extends below the cut line 43, is not thickened and will not be used to introduce direct current into the tag 71. Here, the conductor 73 connects the coil 29 and the capacitive plate 37. Tag 71 is configured to enable the initial operation of the circuitry without clipping the bottom of the tag 71. Except for the absence of some of the structures shown in FIG. 1, the other structures are labeled identically.

Here, the clipping of the bottom of the tag 51 along cut line 43 will simply open the circuit, and disable the ability of the tag 71 to trigger the alarm. This configuration is of value, since most bulk clothing is brought into the rear portion of a store where there is no alarm system. Even where the clothing is brought into the front entrance of a boutique, the alarm system can be disabled during the bringing in of the clothing. Disablement of the system will not be generally known to the customers currently shopping, and the system should suffer no noticeable disadvantages.

Figure 7:
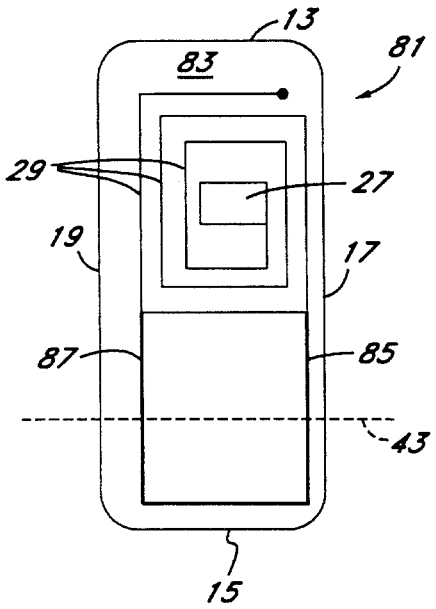
FIG. 7 illustrates a first side of a two sided tag having a via communicating with a second side.

Referring to FIG. 7, a first side of a two sided tag 81 is shown. Tag 81 has a first side 83 which contains capacitive plate 27 and coil 29. At the bottom of the two sided tag 81, is the cut line 43, over which extends thickened conductors 85 and 87 which are joined to each other and extend over the width of the lower portion of the two sided tag 81 and below the cut line 43.

Cutting tag 81 will change the inductance value of the coil 29 to take it from a state where it is resonant but at a frequency outside the alarm system range, and into a resonant state within the alarm system range.

Figure 8:
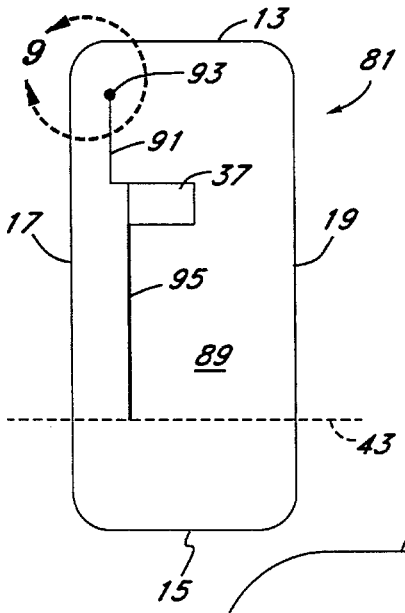
FIG. 8 illustrates the second side of the two sided tag of FIG. 7.

Referring to FIG. 8, the back side 89 of tag 81 has capacitive plate 37. A first lead 91 extends upwardly from the capacitive plate 37 and onto the first side 83 of tag 81 by means of a via 93. The term via includes any means by which a conductor from one side of a planar member or circuit board conductively extends through the circuit board and onto the other side. A second conductive lead or conductor 95 extends downward from the capacitive plate 37, and acts as a utility connection, unlike the conductor 41 of the tag 11 which was used to perform conductive activity below the cut line 43. The purpose of conductor 95 is purely to provide conductive connection during the disablement of the circuitry of tag 81.

The method of disabling tag 81 is the same as for tag 11, namely the introduction of direct current into either of the thickened conductors 85 and 87 and the other conductor 95.

Figure 9:
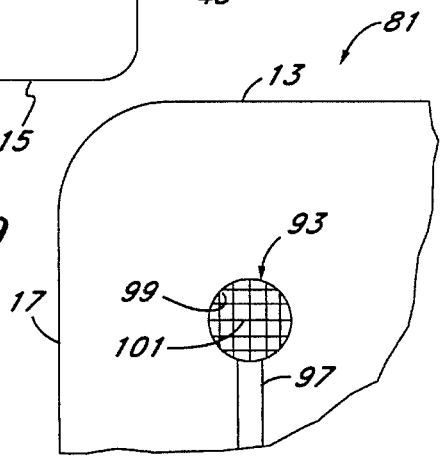
FIG. 9 is an expanded view of the via used in the tag of FIGS. 7 and 8 and illustrating an enlarged mesh which is absorptive and attractive of conductive inks used to form the circuitry of the tag.

FIG. 9 is an expanded view of the upper rear portion of the tag 81 and giving an enlarged view of the via 93, but without the conductive ink which was shown in FIG. 8. Here, a trace path 97 leads up to an aperture 99. Within the aperture 99 are crossing threads 101. The trace path 97 has an affinity for and attracts the conductive ink once the tag 81 is brought in contact with the conductive ink, such as by printing, or where the conductive ink areas such as trace path 97 are provided, simple contact with the conductive ink. The conductive ink fills the trace path and the aperture 99.

The cross threads 101 are preferably made of the same material as the tag 81, but have a spacing which is preferably optimized to perform a capillary-like attraction on the conductive ink and draw it into the aperture 99. The spacing of the cross threads 101 is such that sufficient amounts of the conductive ink will be drawn into the aperture 99, as well as sufficient area of conductivity, to enable sufficient current to pass through the via 93 without overheating or affecting the performance of the circuit of the tag 81. The cross threads 101 may be any mesh-type structure which will enable the establishment of a proper via 93. It is understood that metalization or other types of conductors could be used, and therefore the via may consist of a solid metal pin or plug, or the like.

Figure 10:
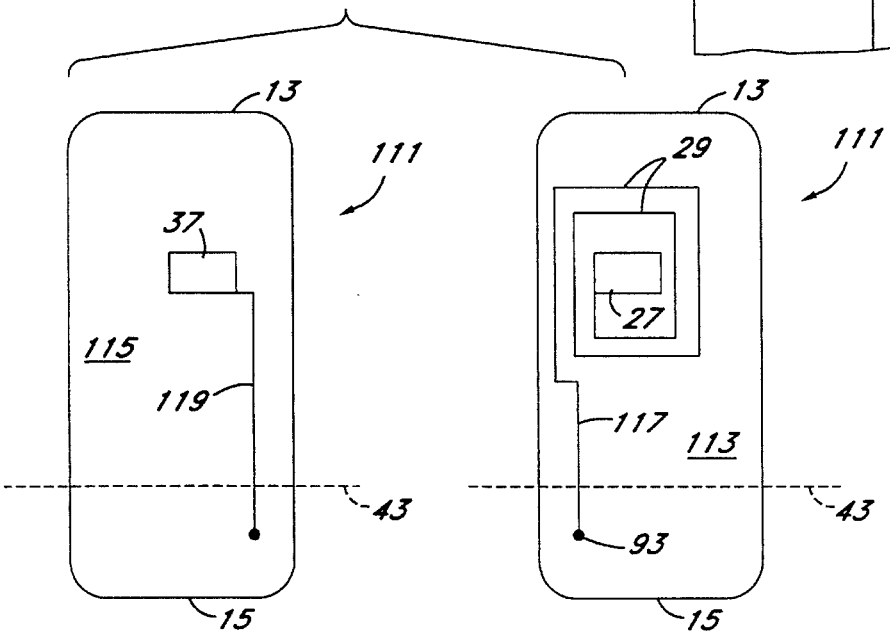
FIG. 10 illustrates a tag similar in overall shape and form as that shown for FIGS. 7–9 and in which the tag is initially armed and where the via is included in the portion of the tag which is to be clipped.

FIG. 10 illustrates a tag 111 similar in overall shape and form as that shown for FIGS. 7–9. In the embodiment of FIG. 10, the tag is initially armed, and then configured where the via is included in the portion of the tag 111 which is to be clipped. Clipping causes the tag 111 to be disarmed.

Tag 111 has a first side 113 which carries the capacitive plate 27 and the coil 29, and a second side 115 which carries the capacitive plate 37. A conductor 117 extends away from the coil 29, while a conductor 119 extends away from capacitive plate 37. The via 93 is below the cutoff line 43, and as such will sever the connection between the front side 113 of the tag 111 and the rear side 115 of the tag 111. Again, the configuration of the tag 111 of FIG. 10 is configured to be initially in the armed state and then to be clipped to the disabled state.

Figure 11:
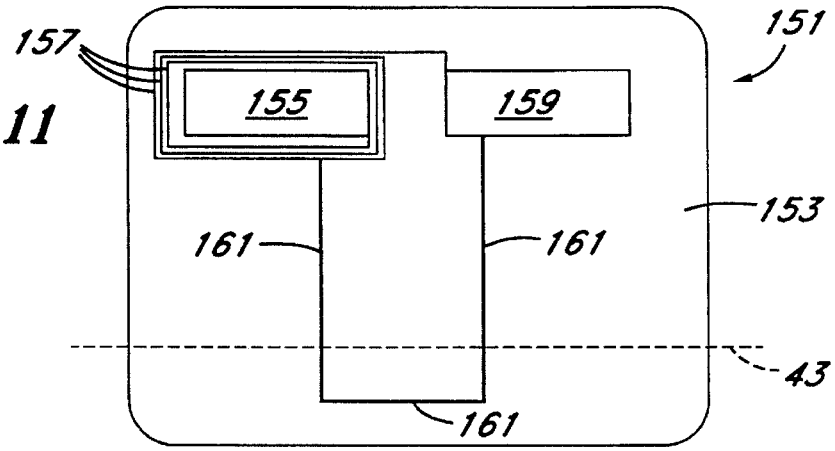
FIG. 11 is an illustration of the front side of a dual capacitor tag having two front capacitive plates, one of which is surrounded by an inductor, and a length of a conductor extending onto a portion of the tag to be cut to thus change the resonant frequency of the tag.

FIG. 11 is an illustration of the front side of a dual capacitor tag 151. A front side 153 has two front capacitive plates, namely a first capacitive plate 155 surrounded by and connected to a coil 157, and a second capacitive plate 159, connected to the coil 157. A thickened conductor 161 connects the coil 157 surrounding the capacitive plate 155 to the capacitive plate 159 by extension across and below the cut line 43.

The cutting of the tag 151 by cutting along the cut line 43 will sever the direct connection between a different portion of the coil 157 and the capacitive plate 159, changing the resonance of the circuit on the front side 153 of the tag 151. The tag 151 can then be disabled by introducing direct current into the thickened conductors 161 to cause direct current to flow in the coil 157 and creating a open circuit directly between the capacitive plates 155 and 159.

Figure 12:
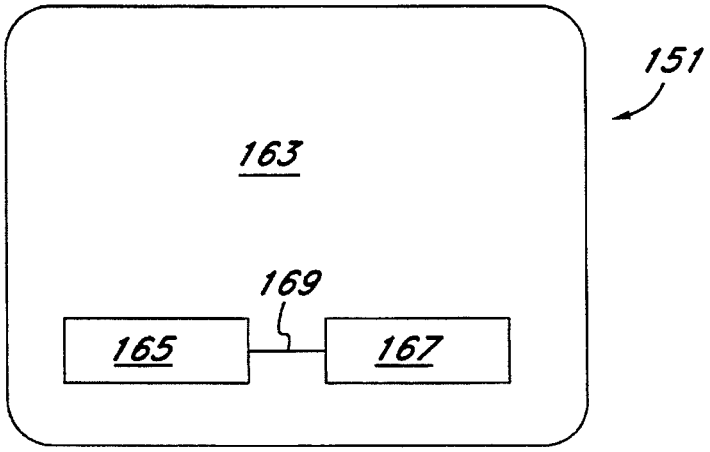
FIG. 12 is a rear view of the tag of FIG. 11 and illustrating a conductively linked pair of capacitive plates located oppositely to the capacitive plates of FIG. 11.

Referring to-FIG. 12, a rear side 163 of the tag 151 is shown and illustrates a third capacitive plates 165 connected to a second capacitive plate 167 through a conductive trace 169. Third capacitive plate 165 is located opposite the first capacitive plate 155, while the fourth capacitive plate 167 is located opposite the second capacitive plate 159. In this manner, the linkage from the first side 153 to the second side 163 is purely an alternating current link, wile the direct current introduction to disable the tag 151 comes directly through the conductors 161 at the point just above the cut line 43.

Figure 13:
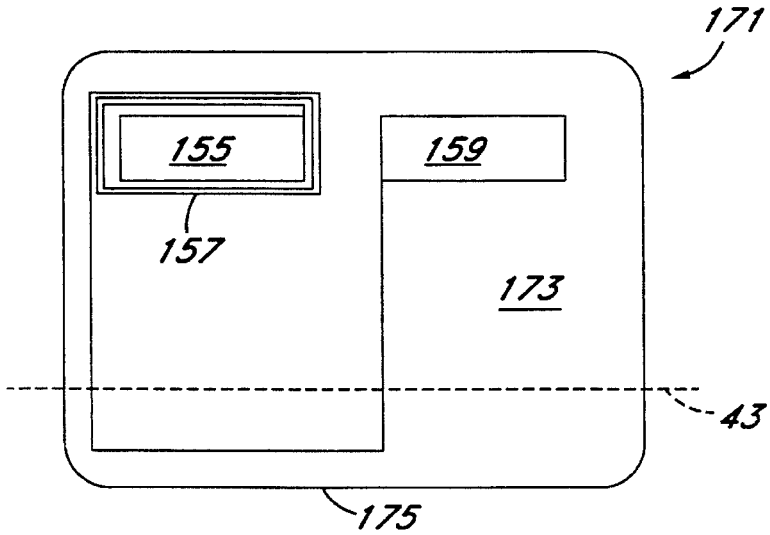
FIG. 13 is an embodiment similar to that shown in FIGS. 11 and 12, but which is armed at the outset and clipped to a disarmed state, and illustrates the front view of the tag illustrating the conductor between the two front capacitive plates extending onto the portion of the tag to be cut to open circuit and disable the circuit carried thereon.

Referring to FIG. 13, a further embodiment is tag 171 which differs from tag 151 only with regard to the layout of a front side 173 which is shown in FIG. 13. The back side of tag 171 is identical to the back side of tag 151.

Tag 171 is similar to tag 151 but is armed at the outset and clipped to a disarmed state. The structures similar with respect to tag 151 will retain the numbering as in tag 151. Front side 173 has two front capacitive plates, namely a first capacitive plate 155 surrounded by and connected to a coil 157, and a second capacitive plate 159, but connected to the coil 157 through an elongated trace 175 which extends below cut line 43. There is no other line connecting the coil 157 with the capacitive plate 159.

The cutting of the tag 171 by cutting along the cut line 43 will sever the only direct connection between coil 157 and the capacitive plate 159, to disable the circuitry of the tag 171. As before, rear side 163 shown in FIG. 12 has the third capacitive plate 165 connected to a second capacitive plate 167 through a conductive trace 169. Third capacitive plate 165 is located opposite the first capacitive plate 155 of tag 171, while the fourth capacitive plate 167 is located opposite the second capacitive plate 159 of tag 171. Again, the linkage from the first side 153 to the second side 163 is purely an alternating current link.

While the present invention has been described in terms of a simplified tag circuit and method of use, one skilled in the art will realize that the structure and techniques of the present invention can be applied to many appliances. The present invention may be applied in any situation where certain verification of operability and non-operability of a circuit is necessary.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A circuit system in the form of a separate tags amenable for attachment to an object to be monitored comprising:

a planar expanse of dielectric substrate having a first side and a second side;

a first capacitive plate formed on said first side of said substrate;

a second capacitive plate formed on said second side of said substrate, and opposite said first capacitive plate;

an inductor formed on one of said first and said second sides of said substrate and having a first end connected to said first capacitive plate, and a second end;

a first length of conductor connecting said second end of said inductor, through said dielectric substrate, to said second capacitive plate;

a second length of conductor connecting one portion of said inductor to another portion of said inductor such that the conductivity through said second length of conductor affects the resonant frequency of said circuit, said second length of conductor extending clearly onto an area of said substrate visually designated to be cut from said substrate with a cut line, to thereby form said tag, and such that after the tag is attached to an object to be monitored, the removal of said area to be cut will thereby change the resonant frequency of said circuit.

2. The circuit system of claim 1 wherein said substrate carries an extended upper area sufficient to be engageably sewn into the seam of a garment and wherein said area of said substrate to be cut carries a lower edge.

3. A security tagged material, including the circuit system of claim 2 wherein said object comprising a cloth object having a seam, the upper area of said substrate sewn into said seam.

4. The security tagged material as recited in claim 3 and where said a first capacitive plate, said second capacitive plate, and said inductor are carried in said upper area of said substrate and are protectively covered by said cloth.

5. The circuit system of claim 1 wherein said a first capacitive plate, said second capacitive plate, said inductor, said first length of conductor, and said second length of conductor are formed of conductive ink and wherein the path of said first length of conductor through said dielectric substrate, to one of said first and said second capacitive plates is through an aperture having an expanded mesh having an affinity for said conductive ink.

6. The circuit system recited in claim 1 and further comprising a third length of conductor extending from said one of said first and said second capacitive plates in the direction of and onto said area of said substrate to be cut to facilitate introduction of current to a portion of said circuit after said area of said substrate to be cut has been removed.

7. A circuit system in the form of a separate tag amenable for attachment to an object to be monitored comprising:

an area of dielectric substrate having a first side and a second side;

a first capacitive plate formed on a first portion of said first side of said substrate;

a second capacitive plate formed on a second portion of said first side of said substrate;

an inductor formed on at least one of said first portion and said second portion of said first side of said substrate and having a first end connected to said first capacitive plate and a second end connected to said second capacitive plate;

a first length of conductor having a first end connecting said inductor between said first and second ends of said inductor and said second capacitive plate and which extends clearly onto an area of said substrate to be cut from said substrate and visually indicated by a cut line, such that when said second side of said substrate is folded together to form said tag such that said first and second capacitive plates oppose each other to form a capacitor and after said tag is attached to said object to be monitored, the removal of said area to be cut will enable said circuit to resonate in a frequency band to be detected.

8. The circuit system recited in claim 1 wherein said first capacitive plate, said second capacitive plate, and said inductor, and said first length of conductor are formed of conductive ink.

9. The circuit system of claim 8 wherein said substrate carries an upper area supporting said first capacitive plate, said second capacitive plate and said inductor to be engageably sewn and concealed into the seam of a garment and wherein said area of said substrate to be cut is sufficiently spaced from said upper area to enable protrusion of said area of said substrate to be cut from said seam.

10. The circuit system as recited in claim 1 and further comprising:

a third capacitive plate on said second side of said substrate and opposite said first capacitive plate;

a fourth capacitive plate on said second side of said substrate and opposite said second capacitive plate; and a second length of conductor electrically connecting said third and said fourth capacitive plates to enable said circuit to resonate in a frequency band to be detected without folding said substrate.

11. The circuit system recited in claim 10 wherein said a first capacitive plate, said second capacitive plate, said third capacitive plate, said fourth capacitive plate, and said inductor, said first length of conductor, and said second length of conductor are formed of conductive ink.

12. The circuit system of claim 10 wherein said substrate carries an extended upper edge sufficient to be engageably sewn into the seam of a garment and wherein said area of said substrate to be cut carries a lower edge.

13. The circuit system recited in claim 1 wherein one of said first and said second capacitive plates and said inductor are on opposite portions of said substrate.

14. The circuit system recited in claim 1 and further comprising a second conductor extending from said inductor from between said first and second ends of said inductor in the direction of said area of said substrate to be cut to facilitate introduction of current to a portion of said first length of conductor.

15. The circuit system recited in claim 1 and further comprising a second conductor extending from said inductor from between said first and second ends of said inductor in the direction of said area of said substrate to be cut to facilitate introduction of current to a portion of said inductor.

16. The circuit system of claim 1 wherein said second side is folded and joined together.

17. A circuit system in the form of a separate tag amenable for attachment to an object to be monitored comprising:

an area of dielectric substrate having a first side and a second side;

a first capacitive plate formed on a first portion of said first side of said substrate;

a second capacitive plate formed on a second portion of said first side of said substrate;

an inductor formed on at least one of said first portion and said second portion of said first side of said substrate and having a first end connected to said first capacitive plate, and a second end;

a first length of conductor connecting said second end of said inductor and said second capacitive plate and which extends clearly onto an area of said substrate visually designated to be cut from said substrate to disable said circuit, and when said second side of said substrate is foldable together and joinable together to form said tag such that said first and second capacitive plates oppose each other to form a capacitor which enable said circuit system to resonate in a frequency band to be detected, and after said tag is attached to said object to be monitored, the removal of said area to be cut will disable said circuit from resonant frequency operation.

18. The circuit system as recited in claim 17 and further comprising:

a third capacitive plate on said second side of said substrate and opposite said first capacitive plate;

a fourth capacitive plate on said second side of said substrate and opposite said second capacitive plate; and a second length of conductor electrically connecting said third and said fourth capacitive plates to enable said circuit system to resonate without folding said substrate.

19. A circuit system in the form of a separate tag amenable for attachment to an object to be monitored comprising:

a planar expanse of dielectric substrate having a first side and a second side;

a first capacitive plate formed on said first side of said substrate;

said second capacitive plate formed on a second side of said substrate, and opposite said first capacitive plate;

an inductor formed on at least one of said first and said second sides of said substrate add having a first end connected to said first capacitive plate and a second end;

a first length of conductor connecting said second end of said inductor, through said dielectric substrate, to said second capacitive plate and extending clearly onto an area of said substrate visually designated to be cut from said substrate, to thereby form said tag, and such that after the tag is attached to an object to be monitored, the removal said area to be cut will thereby disable the operation of said resonant frequency of said circuit.

20. The circuit system as recited in claim 19 and wherein said first length of conductor connects said second end of said inductor and said second capacitive plate through said dielectric substrate through said area of said substrate designated to be cut from said substrate.

* * * * *